US009826876B2

(12) United States Patent
Yang et al.

(10) Patent No.: US 9,826,876 B2
(45) Date of Patent: Nov. 28, 2017

(54) LOW-MOISTURE CLOUD-MAKING CLEANING ARTICLE

(71) Applicant: Kimberly-Clark Worldwide, Inc., Neenah, WI (US)

(72) Inventors: Kaiyuan Yang, Cumming, GA (US); Andrew T Baker, Norcross, GA (US); Joseph R Feldkamp, Appleton, WI (US); David William Koenig, Menasha, WI (US); WanDuk Lee, Appleton, WI (US); Carl G Rippl, Appleton, WI (US); Kathleen C Engelbrecht, Kaukauna, WI (US); Waihong Leong, Alpharetta, GA (US); Dave A Soerens, Neenah, WI (US); Divesh Bhatt, Appleton, WI (US); Jin Heo, Suwon-si (KR); Jose Kollakompil Abraham, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 189 days.

(21) Appl. No.: 14/042,071

(22) Filed: Sep. 30, 2013

(65) Prior Publication Data

US 2015/0089755 A1 Apr. 2, 2015

(51) Int. Cl.

| | |
|---|---|
| ***A47L 13/00*** | (2006.01) |
| ***A47L 13/17*** | (2006.01) |
| *D04H 1/00* | (2006.01) |

(52) U.S. Cl.

CPC ..... *A47L 13/17* (2013.01); *D04H 1/00* (2013.01)

(58) Field of Classification Search

CPC ..... A47L 13/16; A47L 13/17; A47L 13/18; A47L 13/19; A47K 2010/3266;

(Continued)

(56) References Cited

U.S. PATENT DOCUMENTS

| | | | |
|---|---|---|---|
| 3,169,823 | A | 2/1965 | Donald |
| 3,856,684 | A | 12/1974 | Atkinson |

(Continued)

FOREIGN PATENT DOCUMENTS

| | | | |
|---|---|---|---|
| JP | 2005-074132 | A | 3/2005 |
| JP | 2008-101928 | A | 5/2008 |

(Continued)

OTHER PUBLICATIONS

Abu-Rous, M., Varga, K., Bechtold, T. and Schuster, K. C. (2007), A new method to visualize and characterize the pore structure of TENCEL® (Lyocell) and other man-made cellulosic fibres using a fluorescent dye molecular probe. J. Appl. Polym. Sci., 106: 2083-2091. doi: 10.1002/app.26722.*

(Continued)

*Primary Examiner* — Frank Vineis

(74) *Attorney, Agent, or Firm* — Kimberly-Clark Worldwide, Inc.

(57) ABSTRACT

A cleaning article includes a cleaning article sheet comprising a fabric substrate, wherein the fabric substrate includes pores therein, and wherein the fabric substrate has a background moisture percentage by weight, and liquid water disposed substantially and disconnectedly within the pores, wherein the liquid water is at moisture percentage by weight that is 5 to 150 percentage points higher than the background moisture percentage. The nonwoven substrate can include pores formed between and/or within the fibers and can have a background moisture percentage by weight. The substrate can include a treatment to increase the dielectric constant from the dielectric constant of the substrate without the treatment. The moisture of the article can be configured to exhibit a dielectric constant of at least 50% and up to 600% higher than the dielectric constant of the same article with only background moisture.

15 Claims, 8 Drawing Sheets

WATER TRANSFER DIFFERS AT LOW AND HIGH MOISTURE LEVELS

(58) Field of Classification Search
CPC ..... A47K 2010/3273; A47K 2010/328; A47K 2010/3293; A61K 8/0208; B08B 1/006
USPC ..... 442/123–125; 15/208–233; 424/70.12
See application file for complete search history.

(56) References Cited

U.S. PATENT DOCUMENTS

| | | | | |
|---|---|---|---|---|
| 4,117,187 | A * | 9/1978 | Adams | A47K 10/16 15/104.93 |
| 4,328,279 | A | 5/1982 | Meitner et al. | |
| 4,722,739 | A | 2/1988 | Blanchard et al. | |
| 4,810,567 | A | 3/1989 | Calcaterra et al. | |
| 4,946,617 | A | 8/1990 | Sheridan et al. | |
| 5,073,298 | A * | 12/1991 | Gentle | B01D 19/0409 106/490 |
| 5,658,561 | A | 8/1997 | Nakabayashi et al. | |
| 5,728,461 | A | 3/1998 | Nogata et al. | |
| 5,863,663 | A | 1/1999 | Mackey et al. | |
| 5,914,177 | A | 6/1999 | Smith, III et al. | |
| 5,980,931 | A | 11/1999 | Fowler et al. | |
| 6,034,010 | A | 3/2000 | Cartwright et al. | |
| 6,071,549 | A | 6/2000 | Hansen | |
| 6,121,165 | A | 9/2000 | Mackey et al. | |
| 6,511,580 | B1 | 1/2003 | Liu | |
| 6,607,994 | B2 | 8/2003 | Soane et al. | |
| 6,730,621 | B2 | 5/2004 | Gott et al. | |
| 6,964,941 | B2 | 11/2005 | Argentieri et al. | |
| 6,992,054 | B2 | 1/2006 | Lee et al. | |
| 7,078,358 | B2 | 7/2006 | Roberts et al. | |
| 7,122,238 | B2 * | 10/2006 | Macedo | A61K 8/0208 15/104.93 |
| 8,119,233 | B2 | 2/2012 | Chiruvolu et al. | |
| 8,308,699 | B2 | 11/2012 | Zhang et al. | |
| 2003/0021831 | A1 | 1/2003 | Brohagen et al. | |
| 2003/0068454 | A1 * | 4/2003 | Smith | A61F 15/001 428/35.2 |
| 2003/0119705 | A1 * | 6/2003 | Barnabas | A47L 13/20 510/438 |
| 2004/0123962 | A1 | 7/2004 | Shannon et al. | |
| 2004/0202701 | A1 | 10/2004 | Burghardt et al. | |
| 2005/0215144 | A1 | 9/2005 | Ellis | |
| 2005/0217045 | A1 | 10/2005 | Minkler et al. | |
| 2006/0062832 | A1 * | 3/2006 | Lopes | A01N 37/02 424/443 |
| 2007/0228064 | A1 | 10/2007 | Brennan et al. | |
| 2008/0139441 | A1 | 6/2008 | Xiao et al. | |
| 2009/0018048 | A1 | 1/2009 | Mundschau et al. | |
| 2009/0035340 | A1 * | 2/2009 | Landa | A61K 8/0208 424/405 |
| 2009/0056048 | A1 | 3/2009 | Sharifi | |
| 2009/0155335 | A1 | 6/2009 | Oshaughnessey et al. | |
| 2009/0226498 | A1 * | 9/2009 | Flugge-Berendes | A61K 8/31 424/411 |
| 2010/0017982 | A1 | 1/2010 | Pohkamp | |
| 2010/0101605 | A1 | 4/2010 | Saint Victor | |
| 2010/0136072 | A1 | 6/2010 | Haldar et al. | |
| 2010/0203306 | A1 | 8/2010 | Fingal et al. | |
| 2010/0304137 | A1 | 12/2010 | Orlicki et al. | |
| 2011/0081528 | A1 | 4/2011 | Shannon et al. | |
| 2011/0217895 | A1 | 9/2011 | Peterson | |
| 2015/0143647 | A1 * | 5/2015 | Yang | A47L 13/16 15/104.93 |

FOREIGN PATENT DOCUMENTS

| | | | |
|---|---|---|---|
| WO | WO 97/34040 | A1 | 9/1997 |
| WO | WO 00/69423 | A1 | 11/2000 |
| WO | WO 2011/103595 | A1 | 8/2011 |

OTHER PUBLICATIONS

Gottenbos, Bart et al., "Antimicrobial Effects of Positively Charged Surfaces on Adhering Gram-Positive and Gram Negative Bacteria", Journal of Antimicrobial Chemotherapy (2001) 48, 7-13.

Yuan, Jiang et al., "Improvement of Blood Compatibility on Cellulose Membrane Surface by Grafting Betaines", Colloids and Surfaces B: Biointerfaces 30 (2003) 147-155.

Liu, Ping-Sheng et al., "Surface Modification of Cellulose Membranes with Zwitterionic Polymers for Resistance to Protein Adsorption and Platelet Adhesion", Journal of Membrane Science, 350 (2010) 387-394.

Hes, Lubos et al., "The Effect of Moisture on Friction Coefficient of Elastic Knitted Fabrics", Tekstil ve Konfeksiyon, vol. 18, Issue 3, Mar. 2008, p. 206-210.

Liu, Yang et al., "Effect of Trace Moisture on Friction", Applied Physics letters, 96, 2010, pp. 1-8.

* cited by examiner

WATER TRANSFER DIFFERS AT LOW AND HIGH MOISTURE LEVELS

LOW-MOISTURE CLOUD-MAKING CLEANING ARTICLE

BACKGROUND

The general cleaning industry currently sells both dry and wet cleaning products. Wet products are essentially the simple combinations of dry substrates and liquid cleaners (e.g. liquid cleaners and impregnated wet wipes).

Marketing dry and saturated wet products separately worked well in the past when both the cleaning industry as well as the general public paid little or no attention to the potential harms to surfaces/environment/human body from using excess liquid formulations with harsh chemicals. With a rapidly-changing cleaning landscape and an emerging green cleaning trend, continuing to stay on only dry and wet products will face different limitations for addressing these new cleaning challenges. This is particularly true for household cleaning when parents are generally very concerned about the contact between children and harsh chemicals in wet products.

In another fast-growing cleaning segment involving the surface cleaning of various electronic devices or gadgets such as smart phones, tablets, personal music players, televisions, laptops, monitors, etc., it is highly recommended that any liquid cleaners or saturated wet wipes or even tap water be avoided. The limited-liquid requirements, coupled with the demand for wipes free of harsh chemicals, highlight the need to look for technology solutions beyond current liquid-based chemical cleaners and saturated wet wipes. In other words, a cleaning paradigm in which dry and wet benefits are delivered in a single product execution is desired.

Dishrags, sponges, and other durables are used routinely by consumers to wipe down kitchen surfaces and keep surfaces free from germs. However, because these items are frequently stored in a damp condition, they often harbor a large number of germs that can proliferate and thereafter be transferred to surfaces during wiping. As a consequence, their repeated use can in fact be counterproductive in terms of eliminating germs.

Another common approach to clean surfaces of germs is to spray a cleaning solution onto the surface and then wipe the surface with a paper or cloth towel. Yet another approach is to use commonly available moist disinfecting or cleaning wipes. The use of spray cleaners or moist disinfecting wipes adds a level of complexity and inconvenience to the cleaning process. Cleaning fluids and disinfecting wipes are relatively high in cost compared to paper towels. Both cleaning fluids and moist disinfecting wipes typically contain chemicals that are toxic or not meant for skin contact. Due to the toxic nature of the ingredients, cleaning fluids and moist wipes are usually stored away from the countertop and thus not always conveniently located for quick use. The need to locate the product away from the point of use can reduce the frequency of use of the germ control product and thus reduce the effectiveness of the protection sought by the consumer.

Therefore there is a need for an inexpensive and effective germ-removing wiping product that is handy for consumers to use.

SUMMARY

It has been unexpectedly discovered that certain low-moisture cleaning articles are very good at removing germs from hard surfaces. The dislodged germs are then sequestered within the pore structure of the sheet and prevented from re-depositing on the cleaned surface. In fact, it has been determined that such cleaning articles can remove over 99% of the germs from a non-porous surface in the absence of any disinfectants or surfactant-containing cleaning solutions. Germ removal is aided by moisture that is supplied in the cleaning article sheet.

Presented is a cleaning article including a cleaning article sheet comprising a fabric substrate, wherein the fabric substrate includes pores therein, and wherein the fabric substrate has a background moisture percentage by weight, and liquid water disposed substantially and disconnectedly within the pores, wherein the liquid water is at moisture percentage by weight that is 5 to 150 percentage points higher than the background moisture percentage.

Also presented is a cleaning article including a cleaning article sheet including a nonwoven substrate having fibers, wherein the nonwoven substrate includes pores formed between and/or within the fibers, wherein the nonwoven substrate has a background moisture percentage by weight, and wherein the substrate includes a treatment to increase the dielectric constant from the dielectric constant of the substrate without the treatment. The cleaning article also includes liquid water disposed substantially and disconnectedly within the pores, wherein the liquid water is at moisture percentage by weight that is 5 to 150 percentage points higher than the background moisture percentage, and wherein the moisture of the article is configured to exhibit a dielectric constant of at least 50% and up to 600% higher than the dielectric constant of the same article with only background moisture.

Also present is a cleaning article including a cleaning article sheet including a nonwoven substrate having fibers, wherein the nonwoven substrate includes pores formed between and/or within the fibers, and a treatment on the substrate to increase the dielectric constant from the dielectric constant of the substrate without the treatment, wherein the treatment includes a zwitterion. The cleaning article also includes liquid water disposed substantially and disconnectedly within the pores, wherein the liquid water is at moisture percentage by weight that is 5 to 150 percentage points higher than the background moisture percentage, wherein the moisture of the article is configured to exhibit a dielectric constant of at least 50% and up to 600% higher than the dielectric constant of the same article with only background moisture, and wherein the article is configured to remove bacteria by establishing a preferred dielectric gradient of $\in 1$ (wipe)$>\in 2$(microbial debris)$>\in 3$(surface) during wiping.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
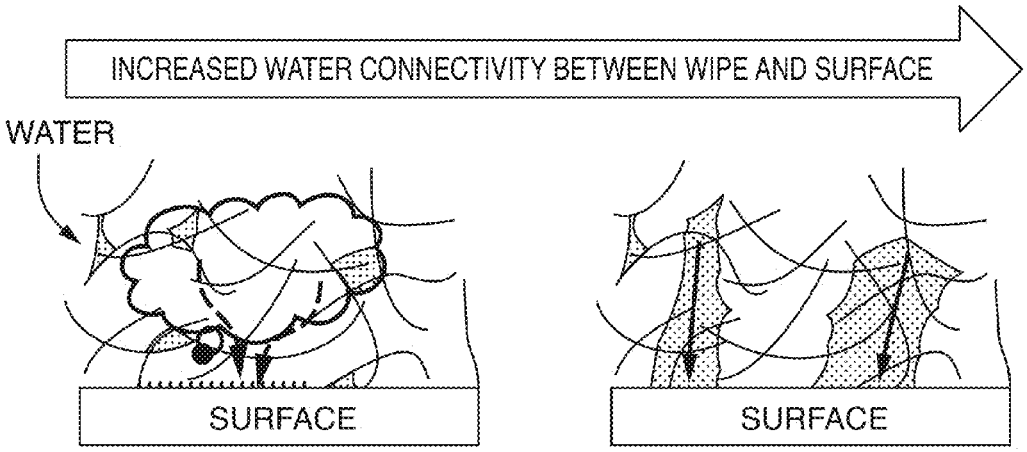
FIG. 1 schematically illustrates moisture loading levels and transfer mechanisms during wiping where the left image represents moisture transfer to the wiped surface through condensation and the right image shows the typical movement of moisture to the surface for highly saturated wipes.

Repeated use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

Combining dry and wet cleaning tools together for improved cleaning efficacy traditionally entails using a dry substrate (e.g., a towel or similar) and a liquid cleaner (e.g., a formulation with disinfectants or detergents or other actives) together. The liquid cleaner can either be sprayed upon the surface to be cleaned or impregnated directly into the dry substrate. In these executions, water is generally considered as a solvent for carrying cleaning actives such as a chemical disinfectant or a detergent or both, while a dry substrate is used for wiping off the cleaning liquid from the surface. In the case of saturated wet wipes, a dry substrate is often needed for the final step of wiping off the residual liquid (e.g., left over from the wipe) from surfaces. Regardless of the amount of formulation loading, water is still considered as a carrier of chemical actives that are intended to do the cleaning.

The disclosure disclosed a new cleaning paradigm in which water is considered as an active and is provided in a wipe or towel at the loading levels as low as ~6-10%. The term "cloud cleaning" describes the cleaning mechanism from which the moisture transfer from the wipe to the surface is achieved by vaporization/condensation through space. The cleaning mechanism is similar to natural rain/dew making (condensation) from cloud (wipe's internal pore structures) and it can be a total chemical-free solution (if only water is the liquid).

The article includes a substrate, such as a wipe or a towel, made from either synthetic fibers, cellulosic fibers, or a combination of both (and optionally other components, such as a film layer, an open-celled foam layer, binder, adhesives, etc.), whereby the substrate includes a liquid, such as water, in an amount from about 6% to an upper limit (for example: 150% by weight), as long as the moisture transfer from the wipe to the surface is done from a vaporization/condensation mechanism (e.g., different from current commercial wet wipes). The preferred range of moisture loading can be different depending on the substrate. The liquid can be a single component or a mixture of components. With respect to porous media, in typical wipes the fluid is all connected. The saturation is high enough that removing fluid from one corner of the wipe will influence the balance of fluid in the rest of the wipe. The saturation level at which this takes place is generally greater than 100% saturation (grams of fluid/gram of dry wipe) for many substrates. The condensation/evaporation mechanism takes place at all saturations, but becomes the dominant form of liquid transport at much lower saturation levels, for example at less than about 40%.

This "low moisture" wipe is able to achieve >99% bacteria removal efficacy per the bacteria removal tests conducted by using a custom procedure combining elements of the AOAC Germicidal Spray Test and the US EPA Protocol for Residual Self-Sanitizing Activity of Dried Chemical Residues on Hard, Non-Porous Surfaces as described in the examples. Dry substrates (with only background moisture) are generally <80% bacteria removal efficacy. The theory, described in more detail below, is that moisture is "condensing" on the surface during the wiping action/pressure from the hand. This condensation, along with dielectric property changes observed from molecular modeling calculations, is what enables the high bacteria removal. The cleaning mechanism is similar to natural rain/dew making (condensation) within a cloud (but from a wipe's internal pore structure) and it can be a completely chemical-free solution, if water is the only liquid.

Data was collected using "microfiber" or 50/50 nylon/PET(polyethylene terephthalate) wipes, HYDROKNIT nonwoven wipes material, and SCOTT paper towels. Tests were conducted with moisture levels ranging from dry to 300% moisture.

Cleaning without harsh chemicals is one of the top needs areas identified and is a fast-growing segment in the cleaning category.

Wet products are essentially the simple combinations of dry substrates and liquid cleaners (e.g., liquid cleaners and impregnated wet wipes).

The present disclosure presents a new cleaning paradigm in which water is considered more as an active than simply a solvent carrier of chemical actives. In this new paradigm, water loading levels and the mechanisms to deliver water to surfaces is controlled and regulated. More specifically, the new cleaning paradigm is enabled by the discovery that selected paper towels, disposable microfiber substrates, and HYDROKNIT nonwovens, when externally loaded with as low as ~6-10% moisture (note: background moisture for a given substrate should be added to the total moisture), can effectively reach >99% bacteria removal efficacy on non-porous and touch screen surfaces without any added disinfectants or chemicals, as shown in Table 1.

TABLE 1

Removal Efficacy for Various Substrates and Surfaces

| Parameters Bacteria | Wipe | Surface | Wiping Condition (Abrasion Machine) Dry (Without external water loading) | Wet (Damp) (~6-10% external Water Loading) |
|---|---|---|---|---|
| *S. Aureus* | Microfiber | Touch Screen | ~35% | >99% |
| ATCC 6538 | (Kim Science) | Glass | ~70% | >99% |
| (Gram Positive) | WypALL-60 | Touch Screen | ~40% | >99% |
| | | Glass | ~82% | >99% |
| *P. Aeruginosa* | Microfiber | Touch Screen | ~72% | >99% |
| ATCC 15442 | (Kim Science) | Glass | ~64% | >99% |
| (Gram Negative) | WypALL-60 | Touch Screen | ~72% | >99% |
| | | Glass | ~66% | >99% |
| *S. Enterica* | Microfiber | Touch Screen | ~71% | >99% |
| ATCC 10708 | (Kim Science) | Glass | ~52% | >99% |
| (Gram Negative) | WypALL-60 | Touch Screen | ~81% | >99% |
| | | Glass | ~79% | >99% |

The use of water and a wipe combination (or a saturated wet wipe at ~300% loading levels) for cleaning is known, but the discovery of the low limits of moisture required in a wipe for >99% bacteria removal is novel. First, a low-moisture wipe is a true chemical-free green cleaning example as only a wipe and water are involved. Second, such a wipe goes against the common practice and belief that water should be provided as abundantly as possible.

Without being held to a particular theory, the concept of "cloud cleaning" describes a mechanism potentially responsible for fast moisture transfer from low moisture level wipes to the surfaces to be cleaned. In this cloud cleaning mechanism, the moisture transfer is realized by fast moisture vaporization/condensation through space (e.g., pore structures of the wipe) at the time scales of normal wiping motions, as shown in FIG. 1.

FIG. 1 illustrates the difference between controlled low moisture cloud cleaning and traditional high (saturated) moisture cleaning. For the former, the moisture in the wipe is largely confined to small pores in discrete and disconnected states. For the latter, the moisture is connected and can move around as a free fluid. Because of the nature of the moisture distribution, moisture transfer from wipe to surface during wiping is thus fundamentally different. The main transfer pathway for a low moisture wipe is through space by a fast moisture vaporization/condensation process that mimics the natural rain/dew making from clouds as well as moisture in the air. As a result, current commercially-available wet wipes, normally loaded with greater than 200-350% wet formulations by weight, are not within the scope of the current disclosure.

The mechanism of fast vaporization and condensation of water through space as clouds has been confirmed by a dynamic wiping station that combines a wiping abrasion tester and a high speed camera system. A novel method for imaging contact between wipers and glass surfaces has provided images of the condensation taking place during wiping. This method makes use of frustrated total internal reflection to generate an image of the points of contact between fluid or wiper fibers and can readily detect condensation occurring during wiping. This method has measured condensation taking place within 50 ms when the hand-side surface of a wipe is at skin temperature (33° C.), and the glass is at room temperature (23° C.).

Increased germ removal efficacy at low moisture levels can partially be attributed to increased friction between wipes and surface by H-bonding or high surface tension of moisture, as shown by LuBos Hes et al. and Liu et al. in their work on moisture level's impact to the friction between wipe and a surface or between surfaces. See LuBos Hes et al., The effect of moisture on friction coefficient of elastic knitted fabrics, *TEKSTLVE KONFEKSYON*, P206, March, 2008, and Liu Y. et al., Effect of trace moisture on friction, Appl. Phys. Lett. 96, 101902 (2010); dx.doi.org/10.1063/1.3356222, Materials Science and Engineering, University of Wisconsin-Madison, Wis. 53706, USA matmodel.engr.wisc.edu/Papers/Liu_APL_2009.pdf. LuBos Hes demonstrated that friction dramatically increases in the friction coefficient studies of elastic knitted fabrics when the moisture content increases from zero to 20~40%, and then levels off without further dramatic increases at higher moisture levels. In contrast, however, bacteria removal data of the present disclosure at low moisture levels are the first example of using such low moisture levels for reaching >99% bacteria removal.

The consideration of water as an active (i.e., not a carrier of traditional cleaning chemicals) for explaining observed >99% bacteria removal efficacy is further supported by theoretical modeling in two ways. First, the condensation (capillary condensation) of water between bacteria and wipe creates a strong attraction force between the two. This attraction force is an order of magnitude larger than corresponding van der Waals forces, creating a strong "lift." Second, water's higher dielectric constant ($\in 80$ versus $\in <5$ for wiping materials) helps to create an environment in which atomic charges associated with molecular fragments in microbial debris fields create image charges in adjacent dielectrics with strength proportional to dielectric constant contrast. Such contrast indicates improved cleaning efficacy when the order of the dielectric constants is manipulated to be:

$$\in 1(\text{wipe}) > \in 2(\text{microbial debris}) > \in 3(\text{surface}).$$

The higher dielectric constant of water ($\in 80$) plays a critical role in elevating the wipe's dielectric constant to be higher than the wiping materials ($\in <5$).

In another hypothesis for explaining water as an active at low moisture levels, bacteria will collapse or die or lose vitality when surface moisture is not sufficient to allow the bacteria to reestablish adhesion to the surface when the bacteria are removed or loosened by a low moisture wipe. The rapid moisture vaporization from wiped surfaces by a low moisture wipe is believed to be further enhanced by the heat generated by friction during wiping motions. It has been shown in the literature that dew formation on a surface from air moisture is highly related to temperature and surface properties. A wipe that can facilitate heat transfer from a user's hand or from a wiping motion (i.e., friction-induced heat) will increase the rate of moisture vaporization and consequently increase dew formation on the surface.

It should be noted that approximately 6-10% of external water loading is the minimal moisture level for >99% bacteria removal, but this does not mean that a cloud cleaning wipe of this disclosure should limit the water loading levels to exactly 6-10%. The key to efficacy is the "through space" vaporization/condensation moisture transfer mechanism, in contrast to all traditional wet wipes. The moisture level stored in a cloud cleaning wipe can be substantially higher than the minimal loading levels for >99% removal as long as the moisture transfer is "through space" vaporization/condensation. As a result, moisture levels for the present disclosure are determined by the intrinsic moisture storage properties of the cloud cleaning article and its materials. This is due in part to the porosity of the article, which is the ratio of the volume of non-fiber space to the total structure volume. In general, transfer in space occurs when the porosity is high, for example approximately >80%. It should be noted that high fluid saturation reduces this open volume through which vapor can move. Low moisture levels enable better movement of moist air through the wiper and therefore enhance the transfer rate due to evaporation and condensation.

Figure 2A:
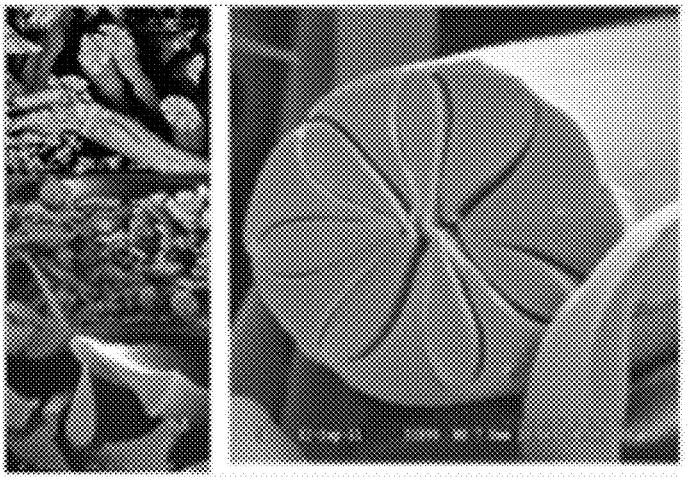
FIG. 2A schematically illustrates the moisture storage microstructures of PET/Nylon (50:50) microfiber.
Figure 2B:
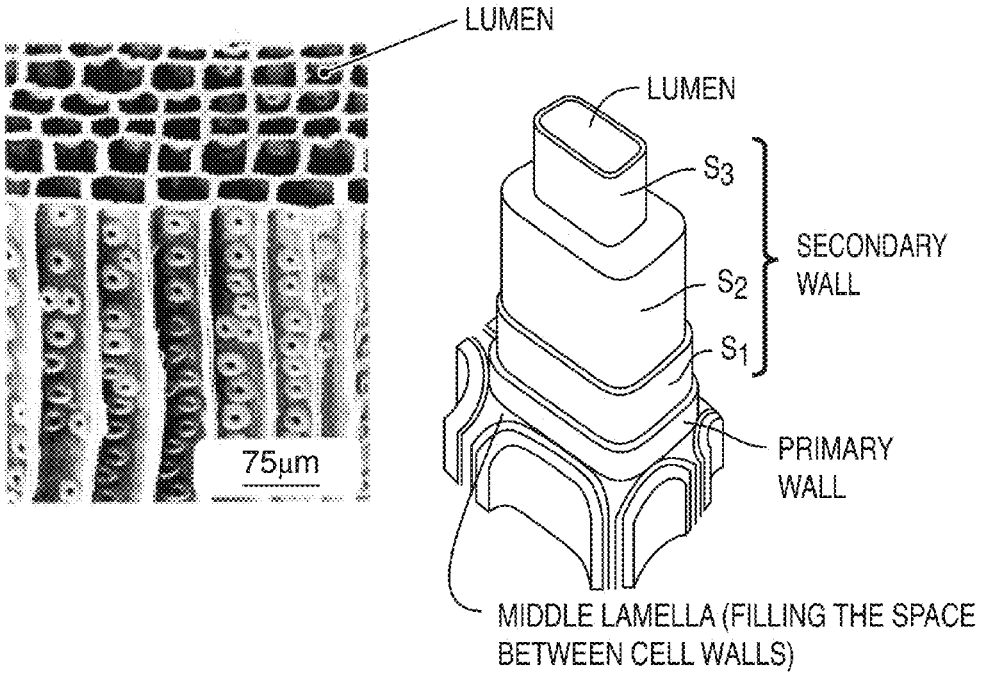
FIG. 2B schematically illustrates the moisture storage microstructures of wood pulp cellulose fibers.
Figure 3:
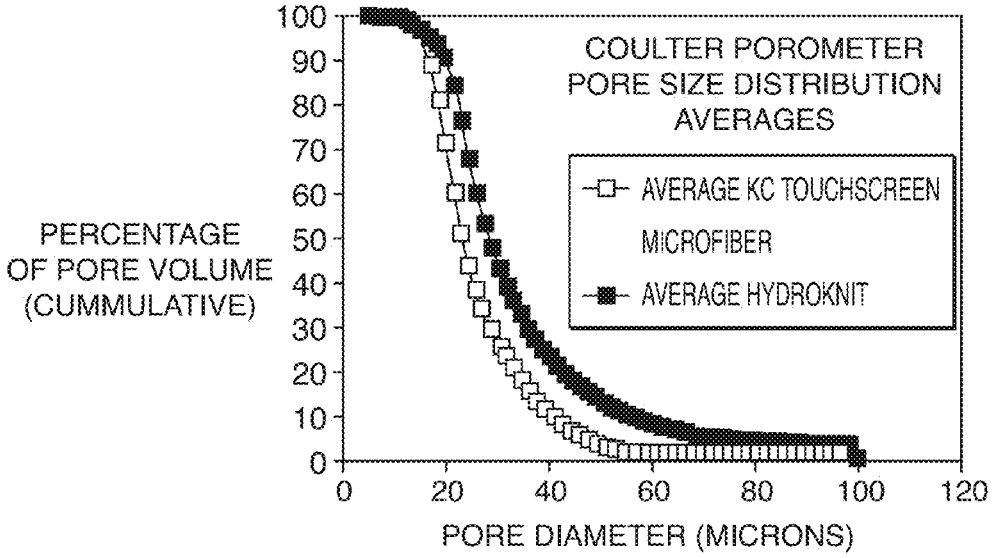
FIG. 3 illustrates pore size distribution of representative microfiber and HYDROKNIT nonwoven wipes materials.

To achieve desired "through space" moisture transfer from a wipe to a surface, the microstructures of a wipe as well as fibers that form the wipe should have a unique capability of allowing moisture distribution in a discontinuous fashion. Such a wipe should have microstructures that can store water in discrete but disconnected zones. In this regard, the bulk water in inter-fiber pores must be minimized to the point that water can only be on the fiber surfaces or in pores or spaces defined by intersections of fibers. In some aspects, the discrete and disconnected "cloud" moisture can be stored at least partially within a fiber's internal pores, such as in engineered (microfiber) and naturally-formed lumen (cellulose) structures. Examples of such engineered or naturally-formed discrete but disconnected zones include but are not limited to segmented microfibers and cellulose fibers with lumen and wall pores (see FIGS. 2*a* and 2*b*).

Regardless of how such engineered or naturally-formed discrete but disconnected zones are made, the pores associated between or within fibers should be physically identifiable and be small enough to function as the seeds of the "clouds." Preferably, the percentage of pore sizes less than 100 microns for engineered or naturally-formed discrete but disconnected zones should be at least 90-95%. More preferably, the percentage of pore sizes less than 50 microns for engineered or naturally-formed discrete but disconnected zones should be at least 80-90%. In some further aspects, the percentage of pore sizes less than 30 microns for engineered or naturally-formed discrete but disconnected zones should be at least 50-70%. Yet, in some further aspects, the percentage of pore sizes less than 20 microns for engineered or naturally-formed discrete but disconnected zones should be at least 20-30%.

Figure 4A:
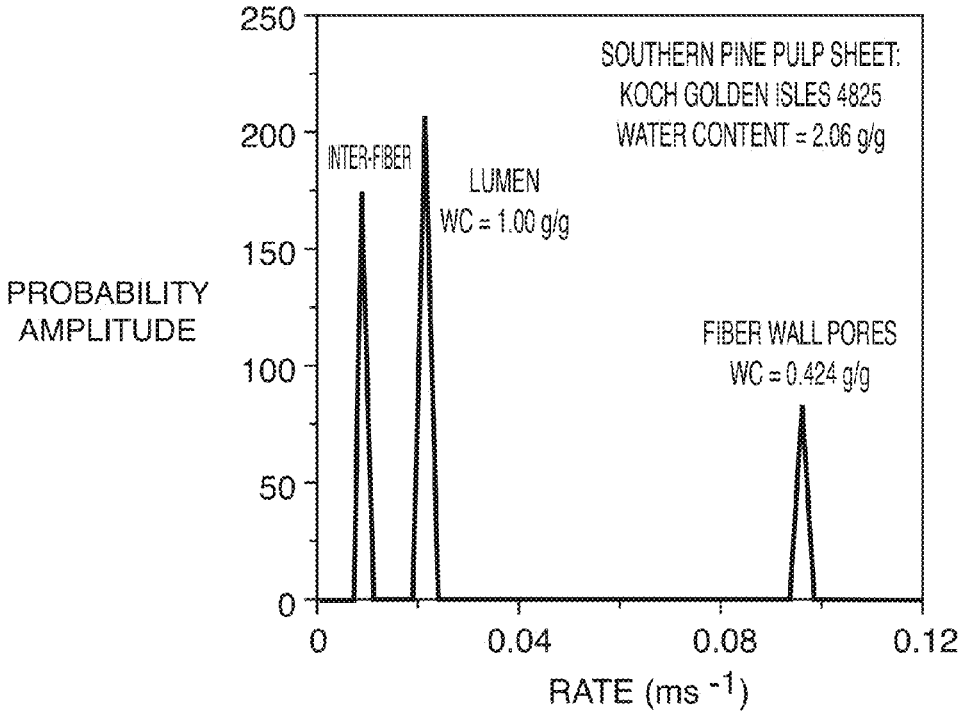
FIGS. 4A, 4B, and 4C illustrate the relationship between pore size and relaxation time.
Figure 4B:
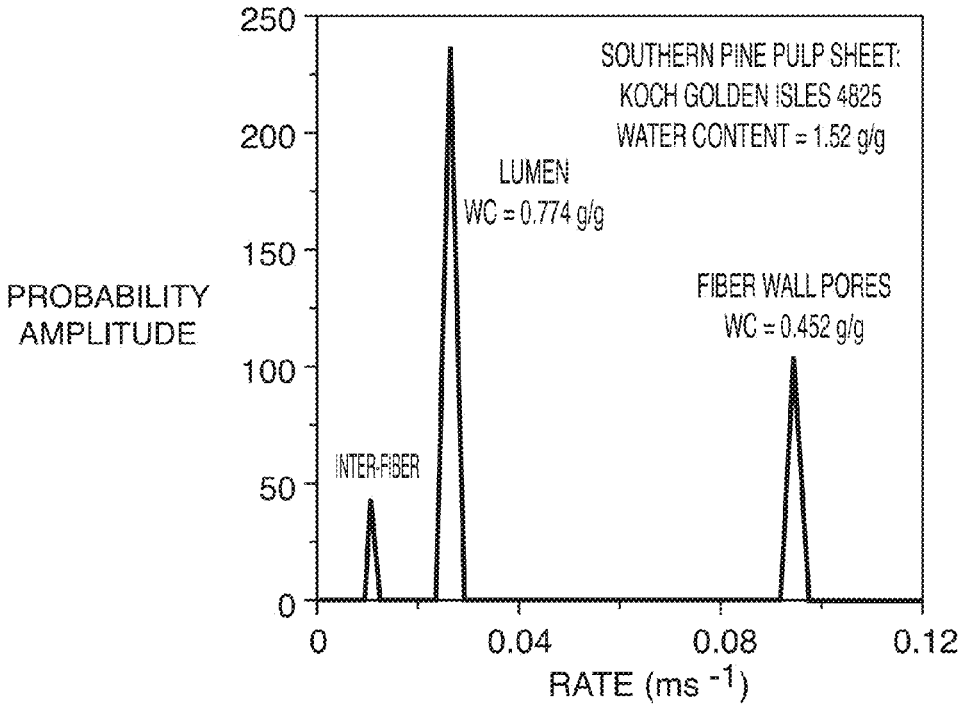
Figure 4C:
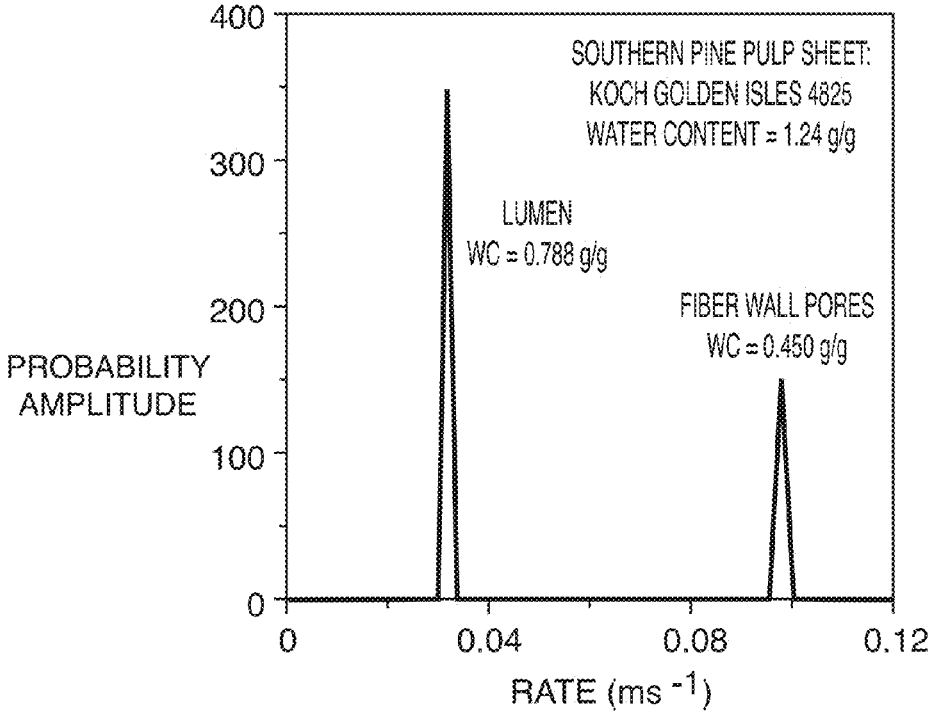

It should be noted that discrete and disconnected cloud moisture only means that the regions of moisture are generally separated and have only limited direct fluid-to-fluid interactions. The moisture is still in active and dynamic communications by vapor through space. Additionally, water molecules in any discrete and disconnected cloud are also in constant motion by dynamic communications through moving to and from a fiber's wall surfaces as well as lumen or lumen-like walls. As pores get smaller, water molecules visit a surface more frequently; this process can be observed by pulse nuclear magnetic resonance spectroscopy (pulse NMR). In this method, the bulk moisture in inter-fiber pores and cloud moisture in discrete and disconnected pores can be distinguished by monitoring a proton's relaxation time in water as water within a small pore will relax more quickly than water in a larger pore because it has less distance to move to reach a surface (see FIG. 4).

Cloud moisture has been found to gradually become the dominant domain when moisture loading levels are reduced, as evidenced by the rapidly reducing relaxation times in pulse NMR measurements. In one example, a tenfold reduction of relaxation time was observed for microfiber wipe when moisture levels were reduced from 3.4 g/g to 0.25 g/g. In another example, the cloud domain is the only observed moisture when the water loading levels were reduced from 3.3 g/g to 0.25 g/g. From pulse NMR measurements, we have concluded that the cloud moisture should be less than 150% in weight of the wipe, and preferably it should be less than 100%, and in some further aspects less than 50%, and yet in some additional aspects less than 20%. The lowest cloud moisture limits for effective cleaning (e.g., reaching >99% bacteria removal from a hard surface) is at about 5% to 15% moisture.

Any materials and methods that can facilitate rapid moisture vaporization and condensation from a wipe to a surface are within the scope of this present disclosure. Preferably, the amount of the moisture transferred from a wipe to a surface by vaporization/condensation pathway is at least 51% of the total moisture transferred. More preferably, in some aspects, the amount of the moisture transferred from a wipe to a surface by vaporization/condensation pathway is at least 75-85% of the total moisture transferred. In some further aspects, the amount of the moisture transferred from a wipe to a surface by vaporization/condensation pathway is at least 85-95% of the total moisture transferred. Most preferably, the amount of the moisture transferred from a wipe to a surface by vaporization/condensation pathway is at least 95-~100% of the total moisture transferred.

The cloud cleaning articles of this disclosure can be one or more of the following product forms: a dry wipe or towel that combines with an on-demand water dispenser, a cloud cleaning wipe in a sealed package for preserving the moisture, and a feels-dry-but-moist wipe or towel that can maintain moisture levels under open air conditions for >99% bacterial removal.

It should be noted that the scope of the current disclosure can be extended to include any formulation as long as its loading levels of the liquid and its transfer mechanism are within the scope of this disclosure. For example, actives like preservatives and disinfectants can be added into the current disclosure for providing additional benefits like desired shelf-lives and bacteria kill. Surfactants and other cleaning actives can also be added to help clean various other surface contaminants.

Moisture content is calculated according to the weight ratios of added moisture and the dry weight of the article. For example, 10%, 100%, 200% moisture levels means that 0.1 gram, 1 gram, and 2 grams of water will be added to a dry article of 1 gram in weight.

Suitable cleaning article sheets include, without limitation, cellulosic sheets produced by throughdrying, whether creped or uncreped, which are well known in the art. Such sheets have the proper pore size/distribution. By way of non-limiting examples, such cleaning article sheets can be made in accordance with the methods disclosed in U.S. Pat. Nos. 3,879,257 A; 7,642,258 B2; 5,989,682 A; 5,672,248 A; 6,808,790 B2; or 6,423,180 B1, all of which are herein incorporated by reference.

The products of the present disclosure have the capacity to remove germs from surfaces without the presence of an effective amount of an antimicrobial agent. Notably, the cleaning article sheets of this disclosure do not contain an effective amount of an antimicrobial agent, such as non-natural, synthetic antimicrobial agents. The term "effective amount" means that the amount of the antimicrobial agent transferred to a non-porous surface is sufficient to cause a 4 log or greater reduction of viable bacteria on the surface. Examples of synthetic antimicrobial agents are those recognized as active ingredients in antimicrobial pesticides and include the standard quaternary ammonium disinfecting agents such as aliphatic and aromatic alkyl quaternaries such as n-alkyl Dimethyl Benzyl Ammonium Chlorides, n-Didecyl, Dimethyl Ammonium Chloride and n-Alkyl Dimethyl Ethylbenzyl Ammonium Chlorides. The sheets can, however, contain amounts of standard paper making additives, such as cationic wet strength agents, dry strength agents and quaternary ammonium debonders, which can demonstrate some antimicrobial activity, but are not present in an amount sufficient to be effective at killing germs on the surface being wiped.

In the interests of brevity and conciseness, any ranges of values set forth in this specification contemplate all values within the range and are to be construed as written description support for claims reciting any sub-ranges having endpoints that are whole numbers or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5," "from 1 to about 5," and "from about 1 to 5."

The surfaces of the fibers can be modified to enhance their ability to adhere to microbial debris, such as bacteria. From a continuum point of view, this is accomplished by manipulating surface chemistry so that the dielectric constant on the fiber surface is greater than that of the microbial debris. From an explicit atom point of view, polysaccharide- or zwitterion-grafted fiber surfaces positioned adjacent to microbe surfaces experience a nano-capillary condensation event that facilitates strong microbe attachment to the fiber surface in moderate moisture conditions. Fibrous wipes can be prepared with the desired surface graft by using various alkoxysilane coupling agents to tether the zwitterion group to a cellulosic type surface. This aspect enhances the "green" nature of this disclosure by increasing the effectiveness of the cleaning article without the use of chemical components that can transfer to the environment.

This effect can be examined from a mixed length-scale perspective: fibers are considered as a dielectric continuum, and the microbial debris as a molecular system embedded within a dielectric continuum. The molecular system generally consists of the typical suite of polysaccharide chains tethered to a Gram-Negative bacterium, e.g., lipo-polysaccharide (LPS). Adhesion can be attributed to the development of image charges formed within the fiber continuum in response to the partial atomic charges belonging to the polysaccharide chains. It was found that adhesion is caused by the attraction between partial atomic charges and their images. Because fibers having a higher dielectric constant develop higher image charges, a higher fiber dielectric constant is considered desirable. However, an increased dielectric constant in the space occupied by polysaccharide chains suppresses the adhesive interaction. Because moisture plays a role in setting dielectric constant for either fiber or microbial debris spaces, the existence of a moisture content optimum is expected, so that with either too much or too little water, adhesion is suppressed. Thus, enough moisture needs to be present to enhance the dielectric constant of the fiber surface, but not so much that microbial debris is saturated with water and unable to stick to the fiber.

Figure 5A:
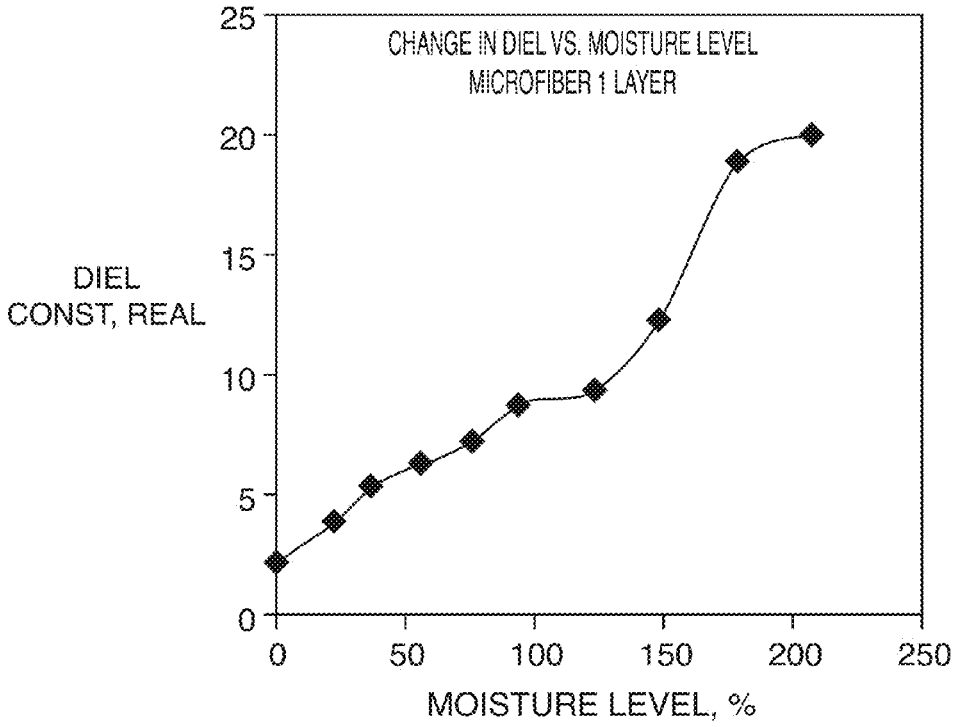
FIGS. 5A and 5B illustrate wipe dielectric changes due to moisture loading for microfiber and hydroknit cloths, respectively.
Figure 5B:
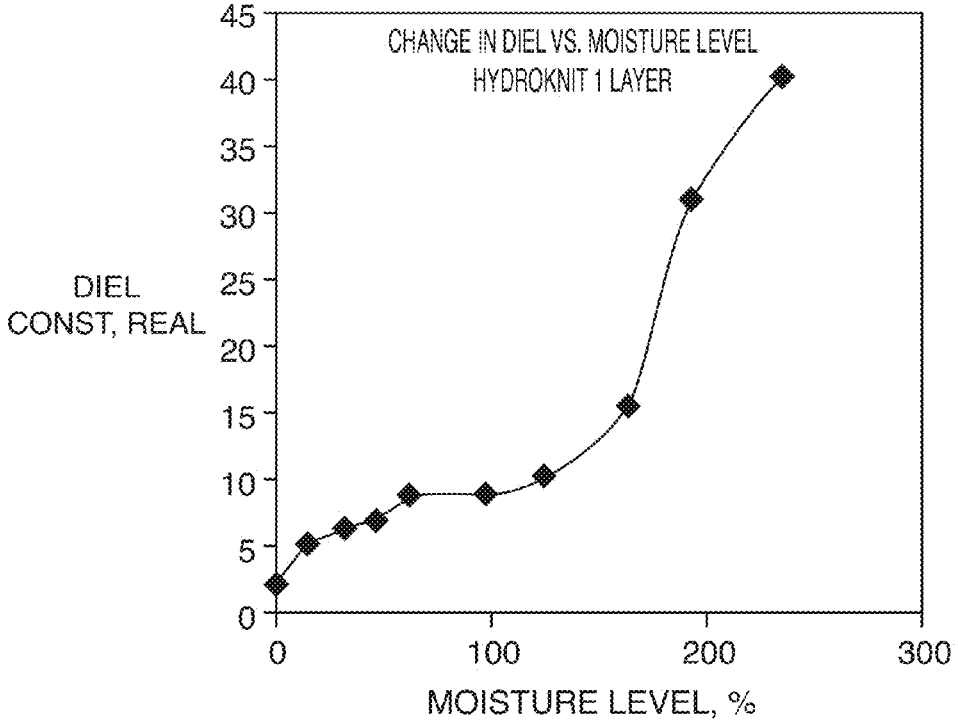

In one aspect, an optimal dielectric constant for the microbial debris/film can be found. For example, if the surface to be cleaned has a dielectric constant designated as e(surf), then the desired or target dielectric constant of the film that contains bacteria, denoted by e(film), is optimal when e(film)=2.414 e(surf). As an illustrative example, if the surface to be cleaned has a dielectric constant of 3.5 (a very common value), then the most effective removal of bacteria from that surface will happen when the film dielectric constant is raised to 8.45. Going above that value by adding more water to the film would produce no benefit. Going below that value by taking water out of the film/system will give poorer performance. Further, if the fiber is going to adhere to the bacterial debris film, then the fiber should also have a dielectric constant in excess of 8.45 (preferably much higher—say greater than about 20). This correlation is illustrated in FIGS. 5*a* and 5*b* for microfiber and hydroknit, respectively.

In most aspects of the present disclosure, the wiper-fiber dielectric constant should be at least 15, preferably at least 20, and more preferably at least 30. Note that a higher dielectric constant in the film that includes the bacteria will call for a higher dielectric constant on the fiber surface in the wipe. That is why there is little need to add water to the bacterial film.

Typical basesheets used in various applications are cellulose fibers and PET/Nylon microfibers; the fibers in these basesheets have dielectric constants that are at approximately 3, and usually smaller than 5. For example, the dielectric constant in such basesheets can be gradually increased from 2.5 to over 15 when moisture ranges increase to about 150%, roughly a 600% increase. In a specific example, a 50% increase in dielectric constant can result from moisture loading levels at about 10%. More moisture can be added to get dielectric constants higher than 15, but moisture levels are desirably limited for certain applications, such as less than 150% for touch screens and new emerging surfaces.

It should be noted that the measured dielectric constants are bulk values, not surface values. A bulk value above 15 generally indicates higher values for a surface phase. In other words, a measured bulk dielectric constant of 15 means that the fiber surface phase value should be greater than 15.

In one aspect, moist surface dielectric constant values obtained from molecular dynamics simulation, with and without tethered serine, were 34 and 17, respectively.

This mechanism of action was further confirmed by fully atomistic models. A molecular dynamics approach was used to directly compute the interaction force between two surfaces—one meant to replicate the chemistry found on a typical Gram-Negative bacterium, and the other meant to model a polysaccharide surface or a zwitterion-type group to enhance interaction with water. Serine is an exemplary zwitterion choice. To investigate the role of moisture, and prove the existence of an optimal level of water as described above, these simulations included a humidistat—a simulation device to regulate humidity.

Figure 6:
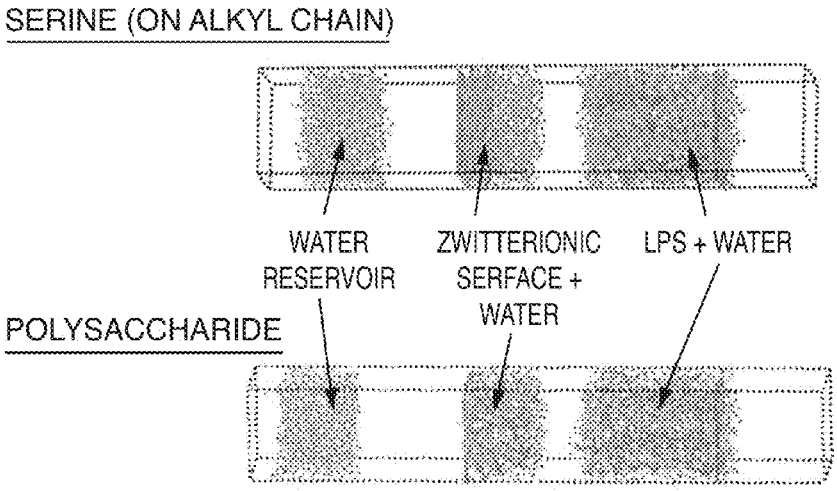
FIG. 6 illustrates interactions on serine and polysaccharide surfaces.
Figure 7:
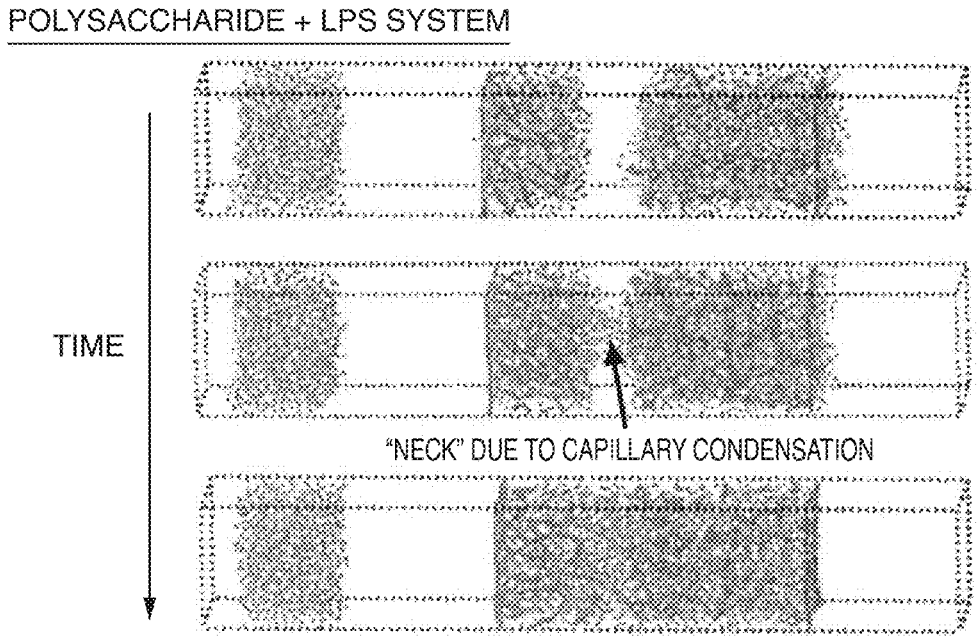
FIG. 7 illustrates the effect of capillary condensation with a polysaccharide surface and a model bacterial surface.

Although the quantitative effect of moisture/humidity level on the two types of wipe surfaces (polysaccharide or zwitterion) is somewhat different, both show dramatic influence of humidity levels. When a surface coated with serine is in equilibrium with a water reservoir (a humidity control device or "humidistat"), most of the water on the serine-coated surface is in proximity with the serine zwitterion, as though this water belongs to the graft surface and thereby produces a region of high dielectric constant. This is illustrated in the top panel in FIG. 6 in which serine (zwitterion) is attached on top of an alkyl chain that is grafted onto the left surface. When a bacterial surface (LPS) is brought closer to the serine-grafted surface, capillary condensation occurs and leads to an attractive force between the serine-grafted surface and the bacterial surface. For the polysaccharide wipe, the whole wipe carries water uniformly (as shown in FIG. 6, bottom panel). Again, when a bacterial surface is brought closer to the wipe, capillary condensation leads to strong attractive forces. The neck formation due to capillary condensation that leads to strong attraction between wipe and bacteria is illustrated in FIG. 7.

Figure 8:
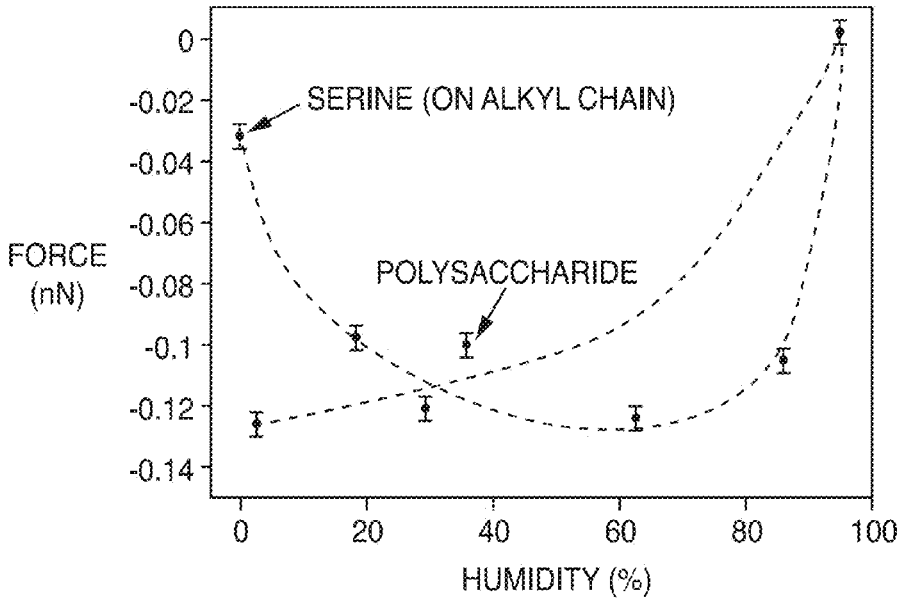
FIG. 8 illustrates the interaction force between a model bacterial surface and a serine-modified surface illustrating the role of humidity and the existence of a humidity optimum.

At moderate humidity levels the attractive force between a serine-grafted surface and a bacterial surface is somewhat larger in magnitude than that between the same bacterial surface and a polysaccharide (hydrophilic) surface, as illustrated in FIG. 8. Thus, at moderate humidity, a serine coated surface is expected to have a greater propensity to "lift" bacteria off a surface than a polysaccharide surface. On the other hand, at very low humidity levels, a polysaccharide wipe is more effective in attracting bacteria. At very high humidity levels (or, wipes completely soaked with water), the ability of either type of wipe to remove bacteria is negligible.

Results of the modeling described above suggest that surface modifications, such as grafting zwitterion on hydrophilic/polysaccharide/cellulosic molecules, allows for a much wider range of bacterial attraction than simply either type of wipes. To this end, various attempts have been made to build the desired surface graft onto cellulosic type fibers. Typically this involves the use of an alkoxysilane coupling agent and the presence of a suitably functionalized zwitterion, such as serine. One example of how this has been accomplished and verified through experiment follows.

EXAMPLES

The following test procedure is used to evaluate the bacteria-removal efficacy of microfiber cloth, although similar tests can be done on any wipe material described in this disclosure, and with any gram positive or gram negative bacteria. The procedure combines elements of the AOAC Germicidal Spray Test and the US EPA Protocol for Residual Self-Sanitizing Activity of Dried Chemical Residues on Hard, Non-Porous Surfaces.

1) Wipe "A" (3 replicates for dry conditions and 3 replicates for wet conditions).

2) Wipe "B" (3 replicates for dry conditions and 3 replicates for wet conditions).

3) Wipe "C" (3 replicates for wet conditions only)

Test substance: *S. aureus* ATCC 6538

Procedure: A daily culture is initiated from the monthly working stock culture and transferred every 24±2 hours, at least three times consecutively prior to the test. From the last daily subculture, the test culture is initiated by transferring a 4 mm (id) loop into a test tube containing 10 ml nutrient broth. Test culture tubes are incubated at 36±1° C. for 48-54 hours. Test cultures are mixed and allowed to stand for ≥10 minutes. A 1:10 dilution of the test culture is performed in sterile nutrient broth supplemented with fetal bovine serum to yield a test microorganism concentration of 1–10×107 CFU/ml and a final fetal bovine serum concentration of 5% (v/v).

Measurement of Removal of Bacteria from a Touch Screen Carrier Under Wet and Dry Conditions A 0.03 ml aliquot of the supplemented test culture is spread evenly over the clear rectangular portion of each screen. Carriers are dried for 30-40 minutes at 36±1° C. The carriers are prepared to achieve approximately a 5 log test organism/carrier concentration after drying.

Wetting of Microfiber Cloth Samples Prior to Treatment: Microfiber cloths used in wet abrasions are prepared individually prior to each wet abrasion cycle by spraying the cloth with sterile distilled water using a sanitized Preval sprayer, from a distance of 75±1 cm for no more than 1 second and used immediately.

Treatment of Inoculated Carriers: Microfiber cloth samples are cut to a width roughly equivalent to the width of the Gardner abrasion boat (~2 inches), and to a length sufficient to attach the ends to the abrasion boat as convenient (~7-8 inches). The final dimensions will be recorded and reported. A Gardner abrasion tester (with 1080-1090 gram weight boat) was prepared as specified in the US EPA Protocol for Residual Self-Sanitizing Activity of Dried Chemical Residues on Hard, Non-Porous Surfaces, except that the "TexWipe cloth wipers" are to be replaced with the microfiber cutouts mentioned above. Inoculated carriers are aseptically placed into the spacers on the floor of the abrasion machine, arranged to accommodate a 4.25"×2.25" touch screen carrier, at surface level with the path of the abrasion boat. Carriers are wiped, per the EPA residual sanitization method, for a total of 2 cycles, where one cycle involves passing over the carrier from right to left and returning back over the carrier from left to right. This procedure is done separately, for each microfiber cloth type and for each microorganism.

Enumeration of Wiped Carriers: Wiped carriers are aseptically placed into a sterile "Whirl-Pak" or equivalent baggie, containing 20 ml Letheen Broth. Harvested carriers are agitated via an orbital shaker set at 200 rpm for a 3 minute±5 second duration. Samples are enumerated using standard dilution and pour plate techniques, with dilutions plated in duplicate.

Experimental Controls: An additional three carriers are inoculated and dried (as in the test above) and harvested immediately after drying, and represents the initial concentration of test microorganism(s) on each carrier prior to treatment. An isolation streak is performed for each test microorganism's test culture to verify culture purity. 0.100 ml of "soil" is plated to appropriate agar for sterility confirmation. A plate or aliquot of all media (growth and enumeration media) is incubated alongside enumeration plates to verify media sterility. The dilute test microorganism culture is enumerated to determine CFU/ml.

Incubation of Plates and Controls: All enumeration plates and controls are incubated at 36±1° C. for 48±4 hours prior to evaluation.

Figure 9:
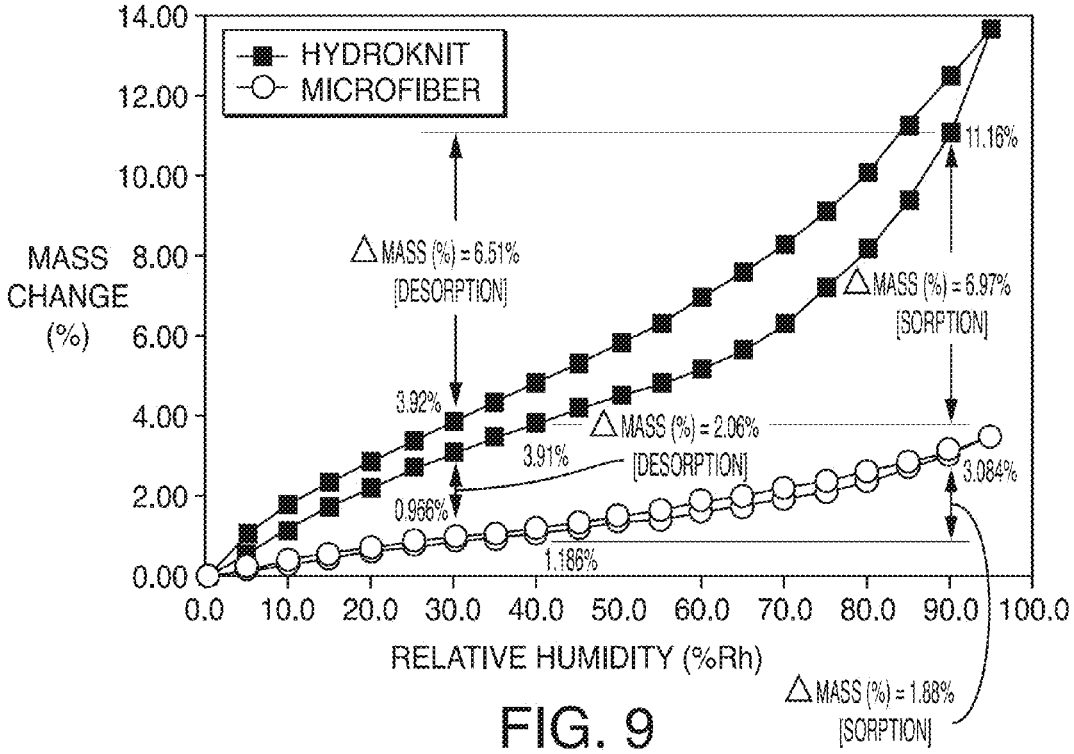
FIG. 9 illustrates the full ranges of background moisture levels for microfiber and HYDROKNIT nonwoven fabric.

Calculations: Carrier Enumeration: [(Plate Count 1+Plate Count 2)/2]×Dilution Factor×Volume Eluent=CFU/Carrier CFU Lift: (Avg. Numbers Control CFU/Carrier)−(Treated CFU/Carrier)=CFULIFT Percent (%) Lift: [(CFULIFT)/(Avg. Numbers Control CFU/Carrier)]×100=% Lift Bacteria removal data were obtained by using dry wipes with background moisture at a relative humidity of approximately 43%. In general, background moisture ranges for wipes should be within 30-60% relative humidity, and temperature ranges between 68°-79° (F.). FIG. 9 illustrates the full ranges of background moisture levels for microfiber and HYDROKNIT nonwoven wipes material at 77° (F.) (25 C.°), measured by Dynamic Vapor Sorption (DVS) instrument (manufactured by Micromeritics Instruments, 4356 Communications Drive, Norcross, Ga. 30093).

Condensation Rate Experimental Method

Equipment:

5+"×10+" Flat test plate made from the material of interest (glass, aluminum, stainless steel)

5+"×10+" flat glass plate for applying moisture

Kimwipes

Balance accurate to 1/100 g

Heated wiper block (see appendix D)

Temperature controlled water bath circulator

Surface temperature measurement system

Air temperature & humidity measurement device

Paper towels

4"×4" Dry wiper base sheet to be tested (3×)

Rubber hand roller (like the speedball hard rubber roller)

10"×10" zip top plastic bags

Stopwatch accurate to the second

Procedure:

a. This work should be done in a laboratory that has a room temperature and humidity of interest.

b. Clean the test plate and place in the laboratory, allowing it to reach room temperature. Test and record the surface temperature of the test plate.

c. Clean the glass plate d. Clean the rubber roller e. Turn on the water circulator and set the temperature to the desired temperature (35° C. for example)

f. Adjust the water circulator temperature until the heated test block achieves the desired "hand" temperature.

g. Saturate (or partially saturate) a piece of paper towel with DI water and lay it flat onto the glass plate. Ensure it is wrinkle free.

h. Weigh a piece of the test wiper material. Record the dry weight as $M_{dry}$.

i. Place a piece of the test wiper material onto the wetted paper towel.

j. Apply pressure to the wiper using the rubber roller. The amount of pressure depends on the desired final moisture content in the wiper.

k. Place in a zip top bag.

l. Record the weight of a single dry sheet of laboratory tissue such as KIMWIPE laboratory tissue. Record this value as $N_{dry}$.

m. Wait for >10 minutes. This provides time for the liquid water to move within the wiper. Different wiper designs may require longer periods of time.

n. Remove the wiper from the bag and weigh it immediately. If the wet weight is too high, allow moisture to evaporate from the wiper into the air. Some adjustment to the saturation level of the paper towel or applied roller pressure may be required to minimize this step. Large amount of evaporation is undesirable because it changes the wiper temperature. Placing the wiper between plastic bags can over time allow the moistened wiper to reach room temperature. Record this value as $M_{wet}$.

o. Quickly place the moistened wiper onto the test plate, and cover with the heated test block. Start the stopwatch.

p. Get the laboratory tissue ready by holding it close to the test block and wiper.

q. After 30 seconds remove the wiper and test block. Immediately wipe the condensation off of the test plate. Crumple up the laboratory tissue into a ball. Keep the tissue covered in your hand as you bring it to the balance.

r. Weigh the crumpled tissue to the nearest 1/100 gram. Record this value as $N_{wet}$.

s. Repeat steps g through r for all of the test samples.

Calculation:

The following formula calculates the moisture content of the moistened wiper.

$$C = \frac{M_{wet} - M_{dry}}{M_{dry}}$$

Where $M_{wet}$ is the mass of the moistened wiper material and $M_{dry}$ is the initial dry weight of the wiper. The moisture content is unitless (g/g).

The following formula calculates the water condensation rate for the test sample.

$$R = \frac{N_{wet} - N_{dry}}{30 \cdot A}$$

Where $N_{wet}$ is the weight of the crumpled tissue and $N_{dry}$ is the dry weight of the tissue. The value A is the area of the heated wiper block in square centimeters. The block design used in this test has A=50 $cm^2$. The condensation rate R is in $g/cm^2$ s.

A study was conducted testing the condensation rate using this procedure. The study investigated the influence of wipe base material type, the wiped surface (base type), and the temperature of the block (hand surrogate). A summary is shown in Table 2.

TABLE 2

Summary of study results.

| Wipe Type | Base Type | Block Set Temp (° C.) | N Rows | Initial Moisture in Wiper (g/g) Mean | Initial Moisture in Wiper (g/g) Standard Deviation | Condensation total ($g/cm^2$) Mean | Condensation total ($g/cm^2$) Standard Deviation | Condensation Rate ($mg/cm^2$ s) Mean | Condensation Rate ($mg/cm^2$ s) Standard Deviation |
|---|---|---|---|---|---|---|---|---|---|
| A60 HK | aluminum | 29 | 3 | 0.988 | 0.084 | 1.1E−03 | 8.8E−05 | 3.5E−02 | 2.9E−03 |
| A60 HK | aluminum | 33 | 3 | 0.694 | 0.105 | 1.3E−03 | 1.3E−04 | 4.3E−02 | 4.4E−03 |
| A60 HK | glass | | 0 | | | | | | |
| A60 HK | glass | 22 | 3 | 0.107 | 0.073 | 4.9E−04 | 1.8E−04 | 1.6E−02 | 6.1E−03 |
| A60 HK | glass | 29 | 3 | 0.906 | 0.099 | 1.2E−03 | 2.3E−05 | 4.0E−02 | 7.8E−04 |
| A60 HK | glass | 33 | 6 | 0.707 | 0.333 | 1.2E−03 | 1.6E−04 | 4.1E−02 | 5.3E−03 |
| Microfiber | aluminum | 33 | 3 | 1.581 | 0.109 | 1.4E−03 | 1.0E−04 | 4.8E−02 | 3.4E−03 |
| Microfiber | glass | 22 | 3 | 0.066 | 0.014 | 4.1E−04 | 2.0E−04 | 1.4E−02 | 6.8E−03 |
| Microfiber | glass | 29 | 3 | 0.413 | 0.073 | 8.9E−04 | 5.4E−05 | 3.0E−02 | 1.8E−03 |
| Microfiber | glass | 33 | 6 | 0.153 | 0.064 | 9.3E−04 | 1.6E−04 | 3.1E−02 | 5.3E−03 |

Figure 10:
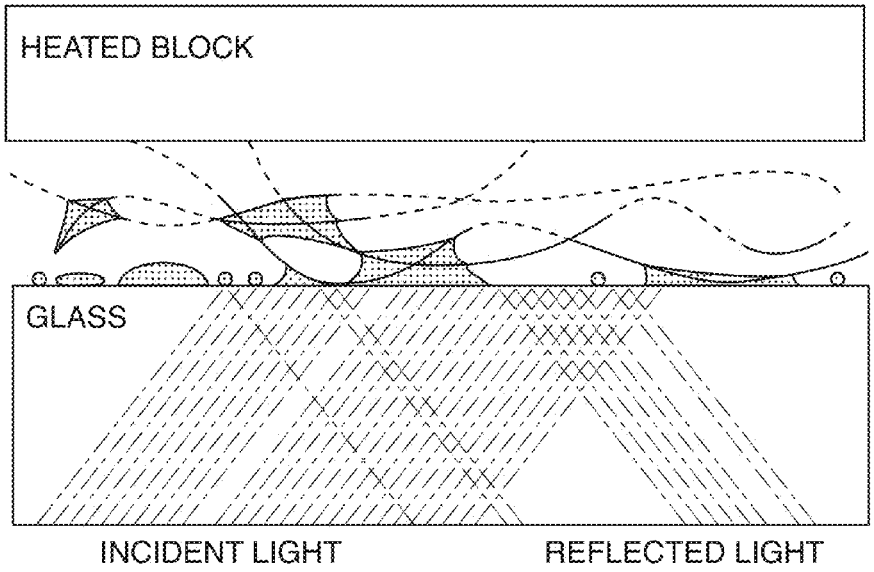
FIG. 10 schematically illustrates the frustrated total internal reflection method.

The diagram shown in FIG. 10 gives a visual representation of the method used to visualize the contact of the wiper fluid and condensed fluid during wiping. Incident light rays are at a low enough angle that they will reflect back off glass/air boundary back into the glass. Viewing the reflected light rays provides an image of the internal surface. The image is bright where nothing is in contact with the glass/air surface. If something is contacting the glass the light will partially or completely transfer into that material and the light will not be reflected off the surface. The loss of reflected light is an indication of where something is in contact with the surface. In the case shown in FIG. 10, condensed fluid (shown as nearly circular drops) will disturb the incident light so it does not reflect back and will show up as a dark spot.

Dielectric Constant Evaluation Method for Nonwoven Sheets:

Dielectric constants of nonwoven materials are characterized for various moisture levels using an E5017C Network Analyzer (Agilent Technologies), LCR Meters (BK Precision LCR Meter 889A), and Agilent 16451 B dielectric test fixtures. The capacitance of a parallel plate capacitor is initially measured and the dielectric constant is computed from the measured capacitance values. Special calibration techniques are developed to characterize samples with higher water content because the conductivity of the sample can impede the output and hence produce wrong results. The nonwoven sheets with high moisture levels are highly conducting and that can cause inaccurate values in test results. The parallel plate capacitor method is also limited in material characterization particularly for thin samples like nonwoven sheets. The limitations in measuring thinner materials are overcome by multiple calibrations of the instrument to lower capacitance values and subtracting any ambient values.

Sample Preparation Procedure: A single sheet of KIMWIPES EX-L nonwoven sheet was cut in half to provide a sample base-sheet weight of approximately 0.22 grams. A 3% solution of serine in water was applied using a small spray bottle equipped with an atomizing orifice. The surface was saturated with the spray and then blotted with a cleaning article—blotting was meant to leave a thin film of solution on fibrous surfaces. Next, a 3% solution of the alkoxysilane coupling agent in methanol was applied with the same type of spray bottle, and again blotted with a cleaning article. Again, the purpose of the blotting was to promote surface reactions rather than bulk reactions. The samples were dried at room temperature and then equilibrated in a room controlled to 50% relative humidity and 70° F. The weight change after these additions was about 0.011 grams or about 5% of the base-sheet weight.

The alkoxysilane coupling agent was Bis[3-(trimethoxysilyl) propyl]amine, available from Sigma-Aldrich.

The effects of successful surface grafting between serine and cellulosic surfaces, joined by alkoxysilane couplers, were verified using pulse NMR relaxation methods. Briefly, water in slightly moistened wipes exists in domains of various sizes—water in a more beaded state considered undesirable, while very thin films of water considered desirable. Pulse NMR relaxation methods determine magnetization relaxation rate(s) for the water phase. Slow relaxation rates are associated with beaded or more bulk-like water, while very fast relaxation rates are associated with water that forms exceedingly thin films on fiber. To put our data in perspective, bulk water has a relaxation rate less than about 0.5 $sec^{-1}$.

Figure 11:
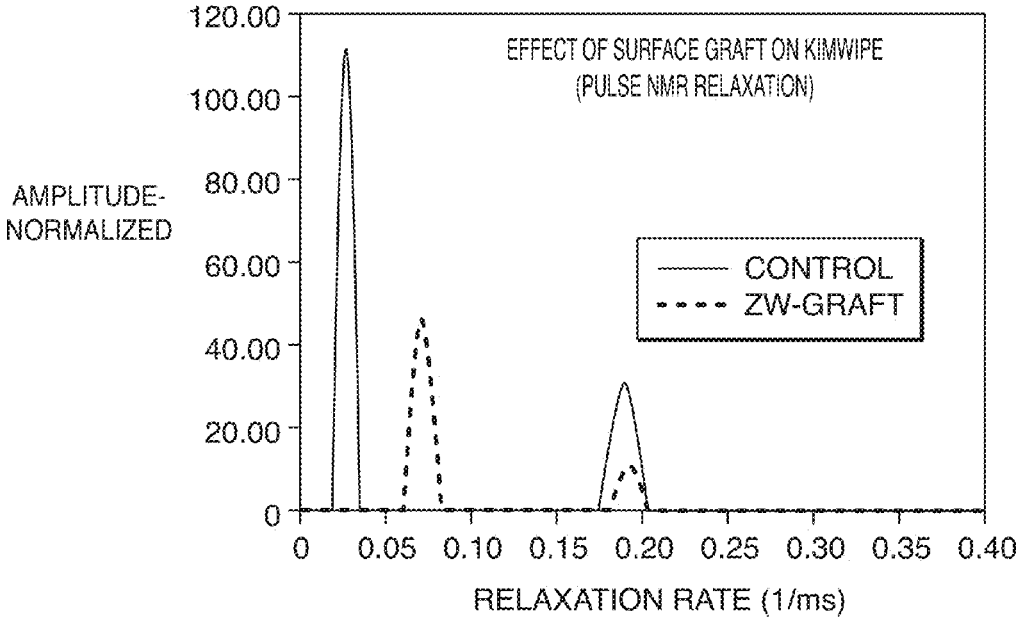
FIG. 11 illustrates pulse NMR relaxation rate spectra revealing the impact of serine, surface grafted onto a cellulosic type fiber —the total peak area is the same for either spectrum, normalized to one; larger peaks at higher rate are most desired.

Table 3 contrasts a KIMWIPE EX-L nonwoven sheet control specimen with a KIMWIPES EX-L nonwoven sheet sample treated as described above. For wipes containing excess water (>1.25 g/g), three relaxation rates are commonly found. In this case, water content is kept below the threshold of 1.25 g/g; thus, only two relaxation rates, or two water domains are present. The columns labeled slow, medium, and fast are meant to give the percentage of the total water that falls into that category. The columns R-x give the speed with which water relaxes to ground state, in each of the observed categories. A greater percentage of the water exhibiting faster relaxation is desirable. In these examples, the four experimental replicates are all much better than the control. Referring to the table, only 15% of water in the control falls into the fast relaxation rate category, while for treated surfaces, about 40% of water exhibits fast relaxation. Thus, much more of the water held within a treated wipe exists in a very thin film state, and proves the positive impact of grafting serine (our model zwitterion) onto a cellulosic type fiber surface. FIG. 11 illustrates the same data, but in a graphical form—peaks corresponding to water domains. Peaks (normalized) located further to the right indicate faster relaxation, i.e., water present in a thin film-like state spread over fibrous surfaces.

TABLE 3

KIMWIPES: Treated and Untreated - Pulse NMR Relaxation Results

| Sample | WC (g/g) | Slow-1 (%) | Medi-um-2 (%) | Fast-3 (%) | Rate1 ($sec^{-1}$) | Rate2 ($sec^{-1}$) | Rate3 ($sec^{-1}$) |
|---|---|---|---|---|---|---|---|
| Control | 1.198 | 0 | 85.5 | 14.7 | | 26.9 | 168 |
| 61-rep1 | 0.991 | 0 | 56.2 | 43.8 | | 50.8 | 180 |
| 61-rep2 | 0.849 | 0 | 66.8 | 33.2 | | 76.9 | 216 |
| 61-rep3 | 0.778 | 0 | 53.7 | 46.3 | | 71 | 190 |
| 61-rep4 | 1.047 | 0 | 59.2 | 40.8 | | 40.6 | 161 |

This disclosure provides a way to enhance adhesion between fibers and microbial debris, so that wipes can be manufactured that offer more effective removal of bacteria. Fiber surfaces are modified through attachment of zwitterionic groups, such as serine or a variety of amino acids or their analogs. Once tethered to a fiber surface, a slightly moistened zwitterionic surface develops a high dielectric constant that then promotes adhesion to a bacterial particle.

The grafting of a zwitterion, such as an amino acid, to the surface of a fiber, such as a cellulosic fiber, through the use of a coupling agent, such as a siloxane coupling agent, provides an enhanced attraction/adhesion between the fibers and microbial debris (bacteria), specifically when slightly moistened (but not totally wet) due to the creation of a region of high dielectric constant. This enables the ability to manufacture wipes that can effectively remove 99.9% of bacteria from a surface with the use of a slightly moistened substrate.

The fiber could be generalized to all fibers containing the appropriate "surface functionalization"—such as surface —OH, —NH2, or —COOH groups, etc. Because just about any fiber can be "functionalized" by UV treatment or some other radiation-type treatment, cellulosic fiber is just one example of many.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description are, in relevant part, incorporated herein by reference; the citation of any document is not to be construed as an admission that it is prior art with respect to the present disclosure. To the extent that any meaning or definition of a term in this written document conflicts with any meaning or definition of the term in a document incorporated by reference, the meaning or definition assigned to the term in this written document shall govern.

While particular aspects of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

We claim:

1. A hard surface cleaning article comprising:

a cleaning article sheet comprising a fabric substrate including fibers, wherein the fabric substrate includes pores therein, and wherein the substrate includes a zwitterion grafted to the fibers to increase the dielectric constant of the substrate from the dielectric constant of the substrate without the zwitterion; and a liquid disposed substantially and disconnectedly within the pores, the liquid consisting of liquid water, wherein the liquid water is at a moisture percentage by weight of 5 to 100 percent, wherein the cleaning article is configured to transfer liquid water to a surface, wherein the majority of water transferred to the surface is transferred by condensation.

2. The cleaning article of claim 1, wherein the pores in the fabric substrate are formed between the fibers.

3. The cleaning article of claim 1, wherein the pores in the fabric substrate are formed within the fibers.

4. The cleaning article of claim 1, wherein the fabric substrate includes cellulosic material.

5. The cleaning article of claim 1, wherein the fabric substrate includes polysaccharide material.

6. The cleaning article of claim 1, wherein the article is configured to reabsorb a majority of the liquid water transferred to the surface.

7. The cleaning article of claim 1, wherein the moisture of the article is configured to exhibit a dielectric constant of at least 50% and up to 700% higher than the dielectric constant of the same article when dry.

8. The cleaning article of claim 1, wherein the moisture of the article is configured to exhibit a dielectric constant of at least 50% and up to 700% higher than the dielectric constant of the same article when dry, and wherein the article is configured to remove bacteria by establishing a dielectric gradient of $\in 1$(wipe) $>\in 2$(microbial debris) $>\in 3$(surface) during wiping.

9. The cleaning article of claim 8, further comprising an alkoxysilane coupling agent.

10. The cleaning article of claim 1, wherein the zwitterion is serine.

11. A hard surface cleaning article comprising:

a cleaning article sheet comprising a nonwoven substrate having fibers, wherein the nonwoven substrate includes pores formed between and/or within the fibers, and wherein the substrate includes a zwitterion grafted to the fibers to increase the dielectric constant from the dielectric constant of the substrate without the treatment; and a liquid disposed substantially and disconnectedly within the pores, the liquid consisting of liquid water, wherein the liquid water is at a moisture percentage by weight of 5 to 100 percent, wherein the cleaning article is configured to transfer liquid water to a surface, wherein the majority of water transferred to the surface is transferred by condensation, wherein the moisture of the article is configured to exhibit a dielectric constant of at least 50% and up to 600% higher than the dielectric constant of the same article when dry.

12. The cleaning article of claim 11, wherein the zwitterion is serine.

13. The cleaning article of claim 11, further comprising an alkoxysilane coupling agent.

14. A hard surface cleaning article comprising:

a cleaning article sheet comprising a nonwoven substrate having fibers, wherein the nonwoven substrate includes pores formed between and/or within the fibers;

a treatment on the substrate to increase the dielectric constant from the dielectric constant of the substrate without the treatment, wherein the treatment includes a zwitterion grafted to the fibers; and liquid water disposed substantially and disconnectedly within the pores, wherein the liquid water is at a moisture percentage by weight of 5 to 100 percent, wherein the cleaning article is configured to transfer liquid water to a surface, wherein the majority of water transferred to the surface is transferred by condensation, wherein the moisture of the article is configured to exhibit a dielectric constant of at least 50% and up to 600% higher than the dielectric constant of the same article when dry, wherein the article is configured to remove bacteria by establishing a dielectric gradient of $\in 1$(wipe) $>\in 2$(microbial debris) $>\in 3$(surface) during wiping.

15. The cleaning article of claim 14, wherein the zwitterion is serine.

* * * * *